US008639166B2

(12) United States Patent
Uno et al.

(10) Patent No.: US 8,639,166 B2
(45) Date of Patent: Jan. 28, 2014

(54) DEVELOPER SUPPLY DEVICE AND IMAGE FORMING APPARATUS HAVING THE SAME

(75) Inventors: Takanori Uno, Aichi (JP); Mitsukiyo Okamura, Aichi (JP); Keisuke Takahashi, Aichi (JP); Suzue Onoda, Shiga (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 132 days.

(21) Appl. No.: 13/361,270

(22) Filed: Jan. 30, 2012

(65) Prior Publication Data

US 2012/0201576 A1 Aug. 9, 2012

(30) Foreign Application Priority Data

Feb. 3, 2011 (JP) ..... 2011-021537

(51) Int. Cl.
*G03G 15/08* (2006.01)

(52) U.S. Cl.
USPC ..... 399/281; 399/266; 399/291; 430/110.2

(58) Field of Classification Search
USPC ..... 399/281, 266, 290, 291; 430/108.1, 430/110.1, 110.2
See application file for complete search history.

(56) References Cited

U.S. PATENT DOCUMENTS

| | | | | |
|---|---|---|---|---|
| 5,142,336 | A | 8/1992 | Hotomi et al. | 399/281 |
| 6,013,404 | A * | 1/2000 | Feng et al. | 430/110.2 X |
| 2003/0064310 | A1 | 4/2003 | Kumar et al. | 430/108.1 |
| 2008/0292362 | A1 | 11/2008 | Ikami et al. | 399/254 |
| 2009/0080942 | A1 | 3/2009 | Nishiwaki et al. | 399/254 |
| 2010/0158577 | A1 | 6/2010 | Nishiwaki | 399/266 |
| 2011/0158706 | A1 * | 6/2011 | Nishiwaki | 399/281 |

FOREIGN PATENT DOCUMENTS

| | | |
|---|---|---|
| JP | 59-176755 | 10/1984 |
| JP | 3-12678 | 1/1991 |
| JP | 2003-149868 | 5/2003 |
| JP | 3540878 B2 | 7/2004 |
| JP | 2008-70673 | 3/2008 |
| JP | 2008-70674 | 3/2008 |
| JP | 2008-281627 | 11/2008 |
| JP | 2009-80271 A | 4/2009 |
| JP | 2009-80299 A | 4/2009 |
| JP | 2010-145911 A | 7/2010 |

* cited by examiner

*Primary Examiner* — Sophia S Chen
(74) *Attorney, Agent, or Firm* — Scully, Scott, Murphy & Presser, PC

(57) ABSTRACT

A developer supply device is provided, which includes a casing including a developer storage section at a bottom portion therein and an opening formed at an end thereof away from the developer storage section, development agent chargeable with a predetermined polarity, stored in the developer storage section, and a transfer board that is disposed in the casing and configured to transfer the development agent stored in the developer storage section when a multi-phase alternating-current voltage is applied to transfer electrodes of the transfer board. The development agent includes a mother particle having, around an outer surface thereof, an electrically insulating layer without a polar group having a charge polarity identical to the predetermined polarity, and an external additive, absorbed to around the mother particle in an easily desorbable manner, which is an electrically insulating fine particle having a charge polarity identical to the predetermined polarity.

12 Claims, 9 Drawing Sheets z

| | AMOUNT OF POLAR GROUPS [mol/g] | | DESORPTION RATE OF EXTERNAL ADDITIVE [%] | SPATULA ANGLE [DEGREES] | CHARGE AMOUNT OF TONER AT ACTIVATING PORTION [fC/3000 particles] |
|---|---|---|---|---|---|
| | − | + | | | |
| 1st WE | 0 | $8.7 \times 10^{-7}$ | 18.8 | 37.5 | 1212 |
| 2nd WE | 0 | $8.3 \times 10^{-7}$ | 4.3 | 37.5 | 931 |
| 3rd WE | 0 | $8.1 \times 10^{-7}$ | 1.4 | 38.0 | 1567 |
| 4th WE | 0 | $1.8 \times 10^{-6}$ | 8.5 | 38.5 | 1135 |
| 5th WE | 0 | $9.2 \times 10^{-7}$ | 10.5 | 40.0 | 1073 |
| 1st CE | $3.2 \times 10^{-7}$ | $1.3 \times 10^{-6}$ | 11.7 | 43.0 | 2086 |
| 2nd CE | $2.0 \times 10^{-6}$ | 0 | 14.5 | 62.0 | 3256 |
| 3rd CE | 0 | $9.4 \times 10^{-7}$ | 0.0 | 50.0 | 1880 |
| 4th CE | 0 | $2.3 \times 10^{-6}$ | 0.2 | 34.0 | 703 |

FIG.5A

| | RATIO OF NEGATIVELY CHARGED TONER [%] | WHITE FOG | TRANSFERABILITY |
|---|---|---|---|
| 1st WE | 8.2 | GOOD | GOOD |
| 2nd WE | 11.8 | GOOD | GOOD |
| 3rd WE | 5.3 | GOOD | GOOD |
| 4th WE | 15.3 | GOOD | GOOD |
| 5th WE | 8.3 | GOOD | GOOD |
| 1st CE | 34.6 | NG | GOOD |
| 2nd CE | 42.5 | NG | NG |
| 3rd CE | 37.3 | NG | NG |
| 4th CE | – | – | BAD |

FIG.5B

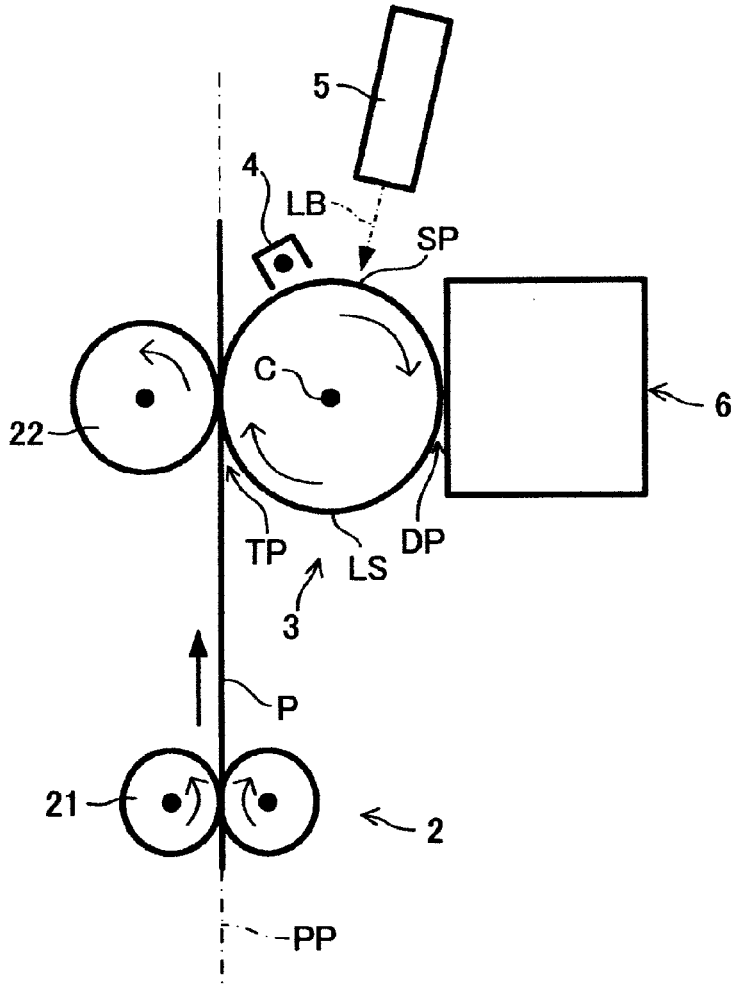
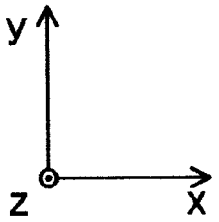
FIG. 8

DEVELOPER SUPPLY DEVICE AND IMAGE FORMING APPARATUS HAVING THE SAME

CROSS-REFERENCE TO RELATED APPLICATION

This application claims priority under 35 U.S.C. §119 from Japanese Patent Applications No. 2011-021537 filed on Feb. 3, 2011. The entire subject matter of the application is incorporated herein by reference.

BACKGROUND

1. Technical Field

The following description relates to one or more techniques for supplying an intended device with powdery development agent charged with a predetermined polarity.

2. Related Art

A developer supply device that includes a developer transfer body having a plurality of transfer electrodes has been known. The developer transfer body is provided on an inner wall surface of a developer container configured to accommodate development agent. The developer transfer body is configured to transfer the development agent to an intended device by a traveling-wave electric field, which is generated when a multi-phase alternating-current voltage is applied to the plurality of transfer electrodes.

Further, a developer supply device has been known that includes a developer carrying member and a transfer board. The developer carrying member, which is a roller-shaped member having a cylindrical-face-shaped circumferential surface, is disposed to face an intended device. The transfer board includes a plurality of transfer electrodes arranged along a developer transfer path. The transfer board is configured to transfer development agent in a developer transfer direction along the developer transfer path by a traveling-wave electric field, which is generated when a voltage is applied to the transfer electrodes. The transfer board includes a vertical transfer board and a bottom transfer board. The vertical transfer board, extending vertically, is configured to transfer the development agent upward in the vertical direction as a developer transfer direction. The developer carrying member is disposed to face an upper end of the vertical transfer board. Further, when a predetermined voltage is applied to between the vertical transfer board and the developer carrying member, generated is such an electric field as to transfer the development agent charged with a predetermined polarity from the upper end of the vertical transfer board to developer carrying member. The bottom transfer board forms a bottom surface of a developer storage section. The bottom transfer board is connected with a lower end of the vertical transfer board, so as to transfer development agent charged by contact or friction with the bottom transfer board, of the development agent stored in the developer storage section, toward the lower end of the vertical transfer board by the traveling-wave electric field. Thereby, the development agent stored in the developer storage section is conveyed to a position where the upper end of the vertical transfer board faces the developer carrying member, along the developer transfer path by the bottom transfer board and the vertical transfer board. Then, the development agent charged with the predetermined polarity is transferred onto the developer carrying member in the aforementioned position by the electric field generated when the aforementioned predetermined voltage is applied. Thus, the development agent is carried on the circumferential surface of the developer carrying member.

SUMMARY

In the known developer supply devices, when an accumulated transfer time for transferring the development agent using the developer transfer body is long, it leads to an unstable charge state of the development agent. For example, it might result in an increased ratio of development agent charged with a polarity opposite to the predetermined polarity (hereinafter referred to as opposite-polarity-charged development agent) to all development agent conveyed toward the intended device. More specifically, in the known developer supply device including the developer carrying member and the transfer board, a long accumulated transfer time for transferring the development agent using the transfer board might result in an increased ratio of opposite-polarity-charged development agent to all development agent carried on the circumferential surface of the developer carrying member. Hence, a final developer image formed on the side of the intended device might be likely to have a trouble such as a white fog. It is noted that the probability distribution of charge amounts of the charged development agent stored in the developer storage section is substantially a normal (Gaussian) distribution with zero as a mean value. Therefore, when a total charge amount of the development agent stored in the developer storage section becomes larger, the ratio of the opposite-polarity-charged development agent carried on the circumferential surface of the developer carrying member rises. Further, a large charge amount of development agent charged with the predetermined polarity and a large charge amount of opposite-polarity-charged development agent are aggregated together.

Aspects of the present invention are advantageous to provide one or more improved techniques for supplying an intended device with development agent charged with a predetermined polarity in a favorable manner.

According to aspects of the present invention, a developer supply device is provided, which includes a casing including a developer storage section provided at a bottom portion therein, and an opening formed at an end thereof away from the developer storage section, powdery development agent chargeable with a predetermined polarity, stored in the developer storage section of the casing, the development agent including a mother particle having, around an outer surface thereof, an electrically insulating layer without a polar group having a charge polarity identical to the predetermined polarity, and an external additive absorbed to around the mother particle in an easily desorbable manner, the external additive being an electrically insulating fine particle having a charge polarity identical to the predetermined polarity, and a transfer board disposed in the casing, the transfer board including a plurality of transfer electrodes arranged along a developer transfer path from developer storage section to the opening, the transfer board being configured to, when a multi-phase alternating-current voltage is applied to the plurality of transfer electrodes, transfer the development agent from the developer storage section toward the opening along the developer transfer path, so as to supply an intended device with the development agent charged with the predetermined polarity.

According to aspects of the present invention, further provided is an image forming apparatus, which includes an image carrying body configured to carry an electrostatic latent image, and a developer supply device including a casing including a developer storage section provided at a bottom portion therein, and an opening formed at an end thereof away from the developer storage section, powdery development agent chargeable with a predetermined polarity, stored in the developer storage section of the casing, the development agent including a mother particle having, around an outer surface thereof, an electrically insulating layer without a polar group having a charge polarity identical to the predetermined polarity, and an external additive absorbed to around the mother particle in an easily desorbable manner, the external additive being an electrically insulating fine particle having a charge polarity identical to the predetermined polarity, a transfer board disposed in the casing, the transfer board including a plurality of transfer electrodes arranged along a developer transfer path from developer storage section to the opening, the transfer board being configured to, when a multiphase alternating-current voltage is applied to the plurality of transfer electrodes, transfer the development agent from the developer storage section toward the opening along the developer transfer path, and a developer carrying body disposed to face the image carrying body, the developer carrying body being rotatably supported at the end of the casing where the opening is formed, the developer carrying body being configured to receive the development agent transferred by the transfer board and supply the image carrying body with the development agent charged with the predetermined polarity to develop the electrostatic latent image carried on the image carrying body.

BRIEF DESCRIPTION OF THE ACCOMPANYING DRAWINGS

Figure 4:
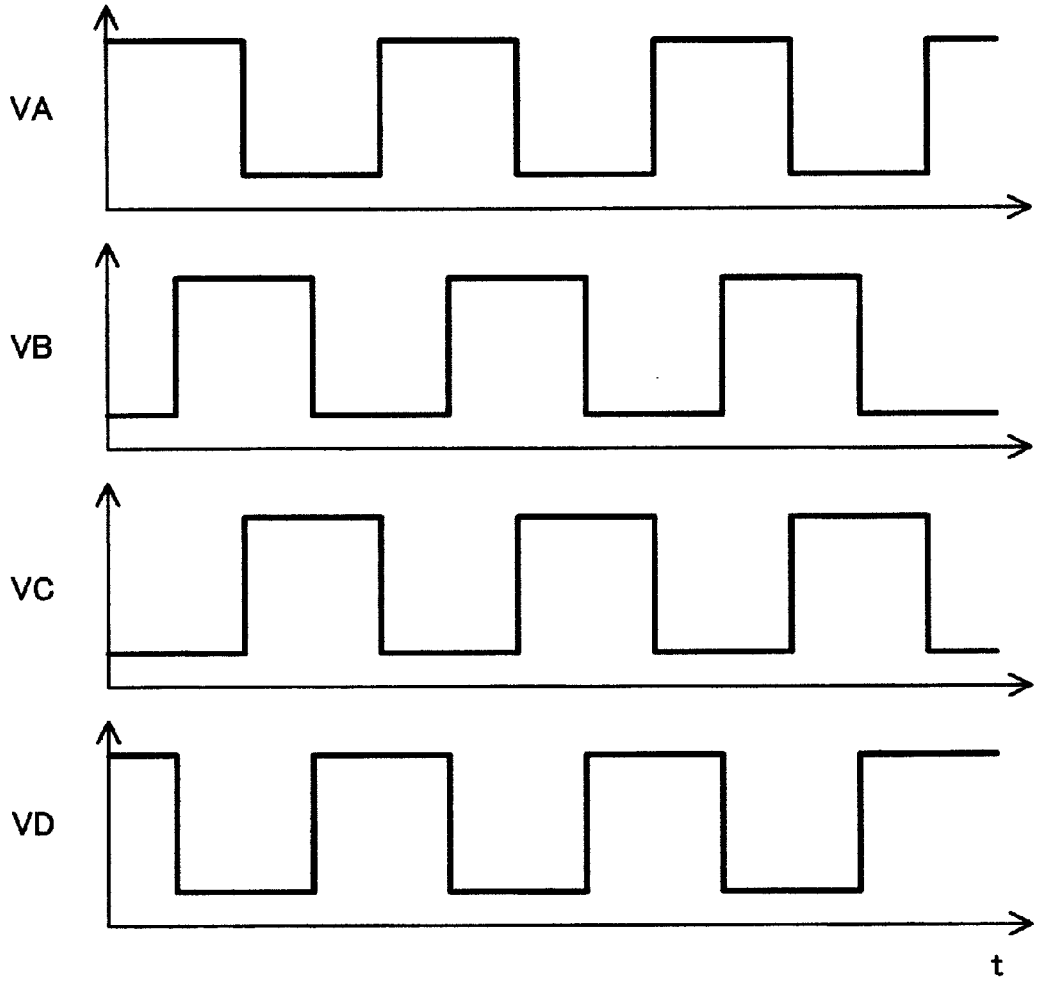

FIG. 4 exemplifies waveforms of voltages generated by power supply circuits for the electric-field transfer board in the embodiment according to one or more aspects of the present invention.

FIGS. 5A and 5B are tables showing evaluation results of first to fifth working examples and first to fourth comparative examples.

Figure 6:
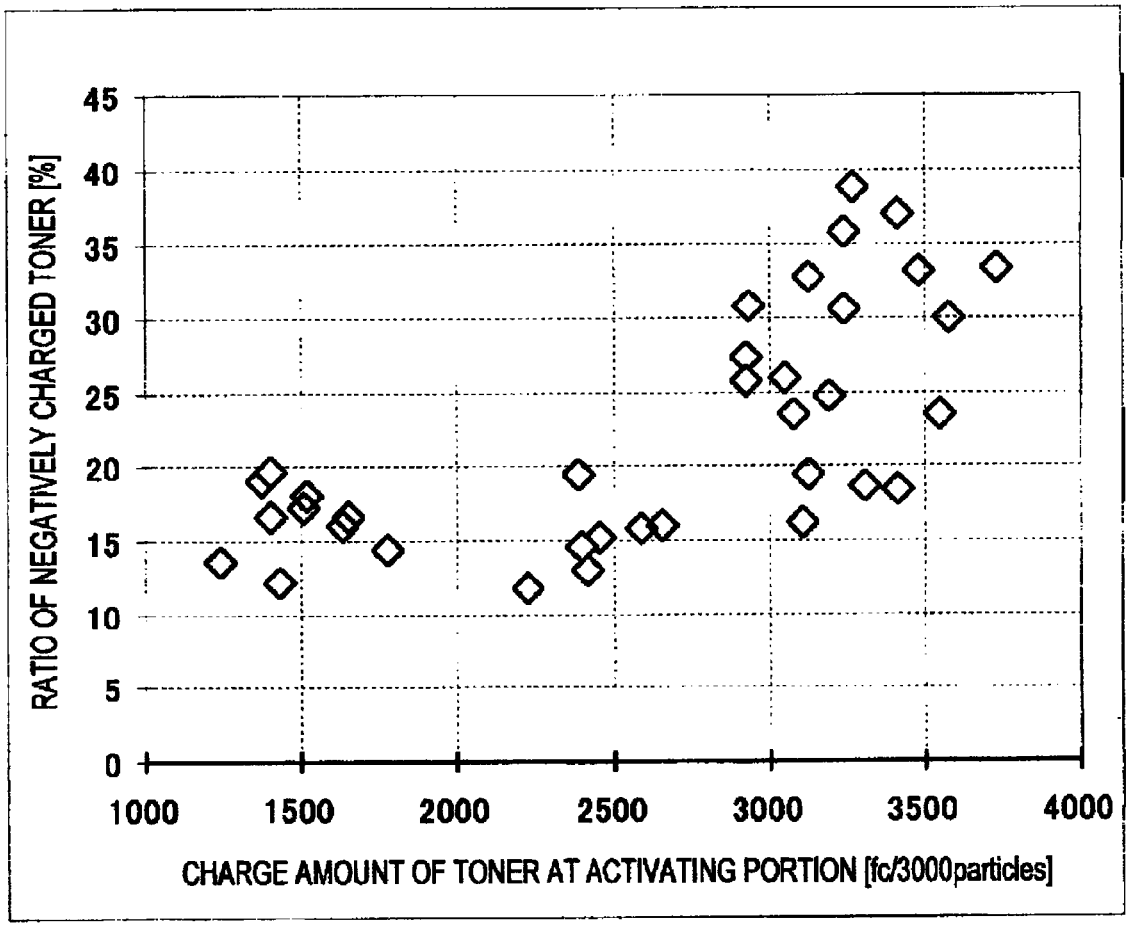

FIG. 6 is a graphically-illustrated experimental result showing a relationship between a charge amount of toner at an activating portion and a ratio of negatively charged toner.

Figure 7:
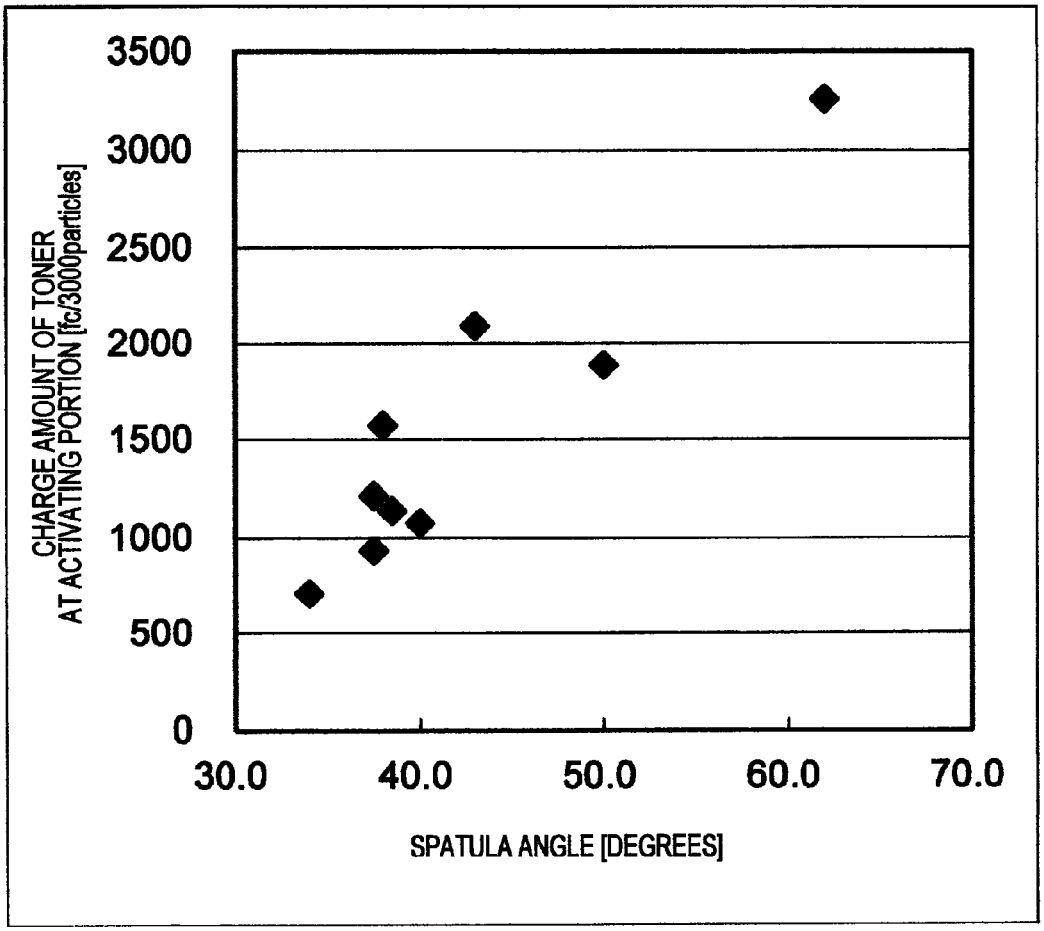

FIG. 7 is a graphically-illustrated experimental result showing a relationship between a spatula angle and the charge amount of the toner at the activating portion.

FIG. 8 is a cross-sectional side view schematically showing a configuration of a laser printer in a modification according to one or more aspects of the present invention.

Figure 9:
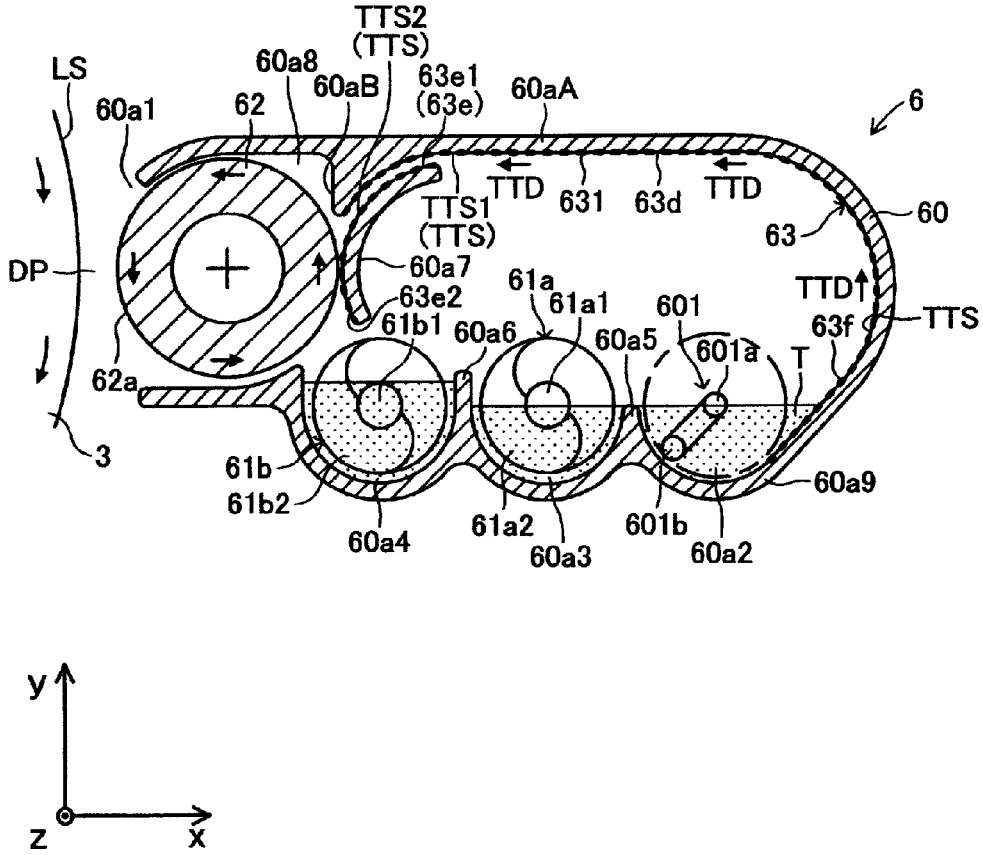

FIG. 9 is an enlarged cross-sectional side view of a toner supply device for the laser printer in the modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration of Laser Printer>

A laser printer 1 includes a sheet feeding mechanism 2, a photoconductive drum 3, an electrification device 4, a scanning unit 5, and a toner supply device 6. The laser printer 1 further includes therein a feed tray (not shown) configured to accommodate sheets P stacked thereon. The sheet feeding mechanism 2 is configured to feed the sheets P in the feed tray along a predetermined sheet feeding path PP on a sheet-by-sheet basis.

Figure 1A:
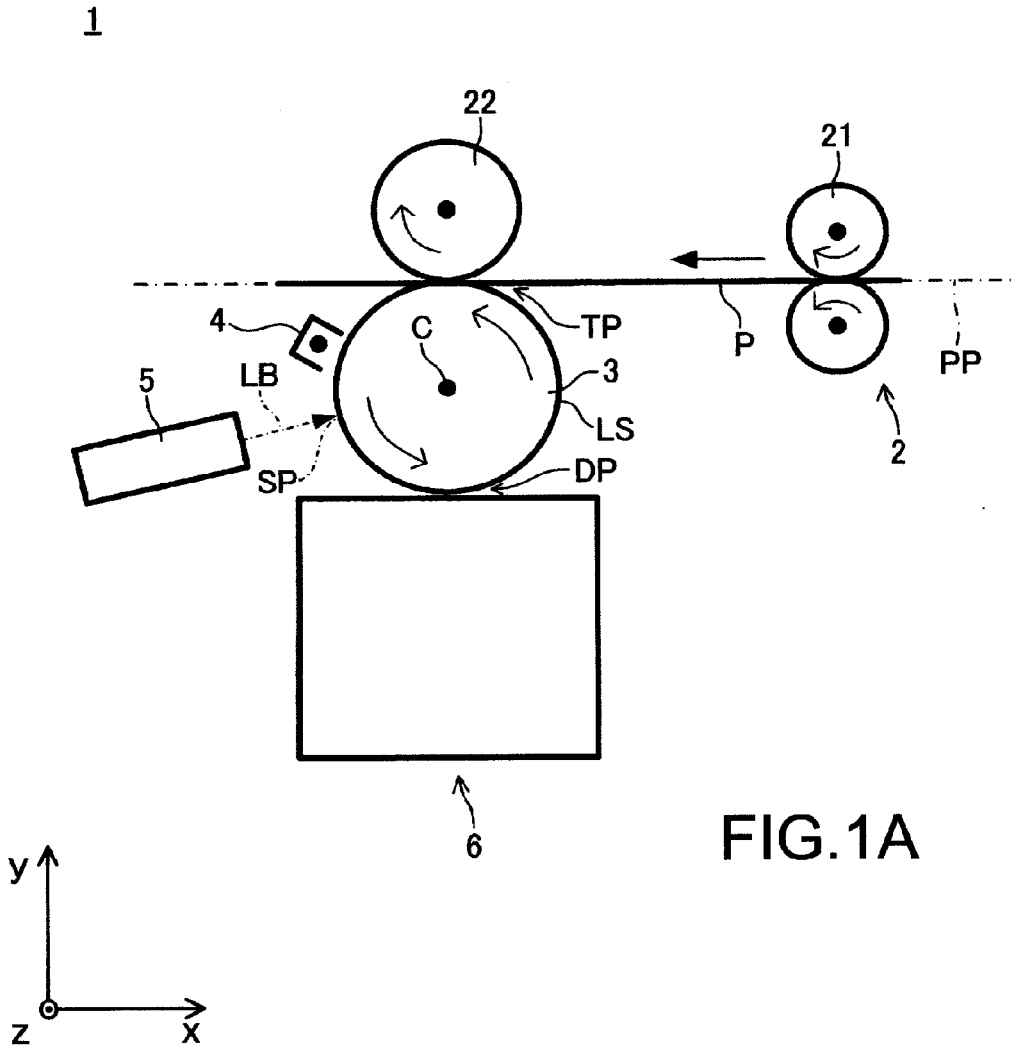
FIG. 1A is a cross-sectional side view schematically showing a configuration of a laser printer in an embodiment according to one or more aspects of the present invention.
Figure 1B:
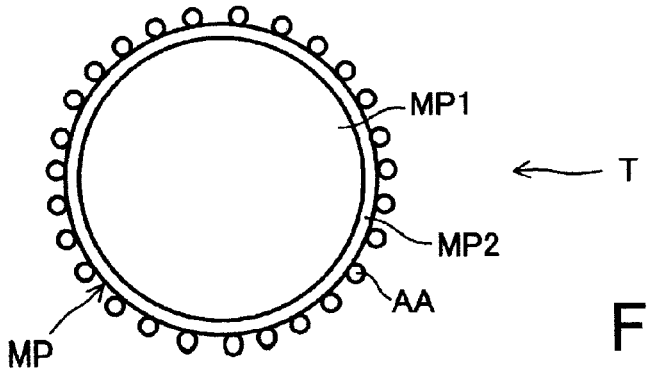
FIG. 1B is a cross-sectional side view schematically showing a configuration of positively-chargeable nonmagnetic-one-component black toner to be used for the laser printer in the embodiment according to one or more aspects of the present invention.

On a circumferential surface of the photoconductive drum 3, an electrostatic latent image carrying surface LS is formed as a cylindrical surface parallel to a main scanning direction (i.e., a z-axis direction in FIG. 1, which direction will hereinafter be referred to as a sheet width direction or simply as a width direction). The electrostatic latent image carrying surface LS is configured such that an electrostatic latent image is formed thereon in accordance with an electric potential distribution. Further, the electrostatic latent image carrying surface LS is configured to carry toner T in positions corresponding to the electrostatic latent image (see FIG. 1B). The photoconductive drum 3 is driven to rotate in a counterclockwise direction indicated by arrows in FIG. 1 around a center axis C parallel to the main scanning direction. Thus, the photoconductive drum 3 is configured to move the electrostatic latent image carrying surface LS along an auxiliary scanning direction perpendicular to the main scanning direction. The electrification device 4 is disposed to face the electrostatic latent image carrying surface LS and configured to evenly and positively charge the electrostatic latent image carrying surface LS. The scanning unit 5 is configured to converge a laser beam LB, which is modulated based on image data, in a scanned position SP on the electrostatic latent image carrying surface LS and scan the convergence point of the laser beam LB along the main scanning direction, so as to form an electrostatic latent image on the electrostatic latent image carrying surface LS.

The toner supply device 6 of the embodiment is disposed under the photoconductive body 3 so as to face the electrostatic latent image carrying surface LS in a development position DP downstream relative to the scanned position SP in a moving direction in which the electrostatic latent image LS moves in response to rotation of the photoconductive drum 3. The toner supply device 6 is configured to supply the positively charged toner T to the electrostatic latent image carrying surface LS in the development position DP. Subsequently, a detailed explanation will be provided about a specific configuration of each of elements included in the laser printer 1.

The sheet feeding mechanism 2 includes two registration rollers 21, and a transfer roller 22. The registration rollers 21 are configured to feed a sheet P toward a transfer position TP (downstream relative to the development position DP in the moving direction of the electrostatic latent image carrying surface LS) between the photoconductive drum 3 and the transfer roller 22 at a predetermined moment. The transfer roller 22 is disposed to face the electrostatic latent image carrying surface LS across the sheet feeding path PP (the sheet P) in the transfer position TP. Additionally, the transfer roller 22 is driven to rotate in a clockwise direction indicated by an arrow in FIG. 1, which direction is opposite to the rotational direction of the photoconductive drum 3. The transfer roller 22 is connected to a transfer power supply circuit (not shown), such that a predetermined transfer bias voltage for transferring onto the sheet P the toner T adhering to the electrostatic latent image carrying surface LS is applied to between the transfer roller 22 and the photoconductive drum 3.

<<Toner Supply Device>>

Figure 2:
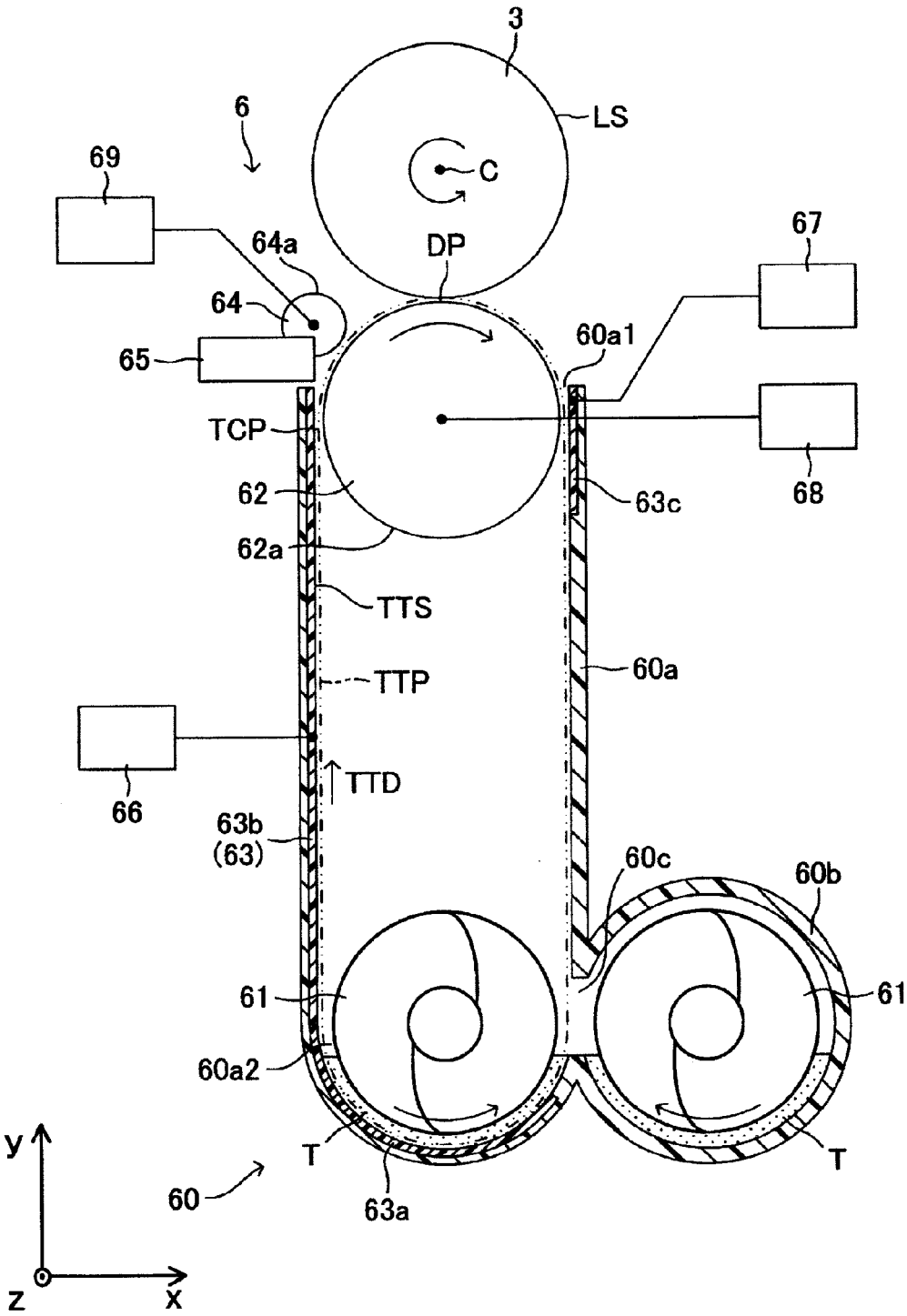
FIG. 2 is an enlarged cross-sectional side view of a toner supply device for the laser printer in the embodiment according to one or more aspects of the present invention.

As shown in FIG. 2, a casing 60, which forms a main body frame of the toner supply device 6, includes a box-shaped main casing 60a that is formed substantially in a U-shape when viewed along the z-axis direction in FIG. 2. Namely, the main casing 60*a* includes an opening 60*a*1 provided at an upper end portion thereof opposite the photoconductive drum 3 so as to open up toward the photoconductive drum 3. Further, the main casing 60*a* includes a toner storage section 60*a*2 that is an internal space of a substantially half-cylinder-shaped bottom portion of the main casing 60*a*. The toner storage section 60*a*2 is configured to accommodate the powder toner T.

The toner T, which is positively-chargeable nonmagnetic-one-component black toner, includes a mother particle MP and an external additive AA attached onto the outer surface of the mother particle MP. The mother particle MP includes a core MP1 of polyester resin and a coating layer MP2 of non-ionic surfactant that is absorbed onto the outer surface of the core MP1. Namely, the mother particle MP has, around the outer surface thereof, the coating layer MP2 as an electrically insulating layer that does not have a polar group of the positive polarity identical to the intended polarity of the toner T. Further, the external additive AA is absorbed to around the mother particle MP in an easily desorbable manner. Specifically, the external additive AA is absorbed to the mother particle MP such that the desorption rate of the external additive AA is equal to or more than 0.5% when the toner T is dispersed in water solution containing non-ionic surfactant of 0.2 weight percent for three minutes using a high-speed shearing machine. In the embodiment, the toner T is produced to have a spatula angle less than 50 degrees. Further, the toner T is produced such that the absolute value of the charge amount of the toner T in the toner storage section 60*a*2 immediately before transferred by an electric field generated by a below-mentioned transfer board 63 (near the transfer board 63 in the process of an electric-field transferring operation) is equal to or more than 800 fC per 3000 particles and equal to or less than 3000 fC per 3000 particles.

The casing 60 includes a sub casing 60*b* that is provided in parallel with the bottom portion of the main casing 60*a* and formed substantially in a cylindrical shape having a center axis parallel to the main scanning direction. The internal space of the sub casing 60*b* is communicated with the toner storage section 60*a*2 inside the bottom portion of the main casing 60*a* via a communication hole 60*c* at each end thereof in the main scanning direction. There are augers 61 housed inside the bottom portion of the main casing 60*a* and the sub casing 60*b*, respectively. The augers 61 are configured to agitate and circulate the toner T in the bottom portion of the main casing 60*a* and the sub casing 60*b*.

The development roller 62 is a roller-shaped member having a toner carrying surface 62*a* that is a cylindrical circumferential surface. The development roller 62 is disposed to face the photoconductive drum 3. The development roller 62 is rotatably supported at the upper end portion of the main casing 60*a* where the opening 60*a*1 is formed. In the embodiment, the development roller 62 is housed in the casing 60 such that a rotational center axis thereof parallel to the main scanning direction is placed inside the main casing 60*a* and that substantially an upper half portion of the toner carrying surface 62*a* is exposed to the outside of the main casing 60*a*.

The transfer board 63 is formed, in the main casing 60*a*, along a toner transfer path TTP that is formed substantially in an oval shape elongated in the vertical direction when viewed along the z-axis direction in FIG. 2. It is noted that a toner transfer direction TTD is a tangential direction of the toner transfer path TTP. The transfer board 63 is fixed onto an inner wall surface of the main casing 60*a*. The transfer board 63 is configured to transfer the toner T by a traveling-wave electric field on a toner transfer surface TTS. In the embodiment, the transfer board 63 includes a bottom transfer board 63*a*, a vertical transfer board 63*b*, and a retrieving board 63*c*.

The bottom transfer board 63*a* is fixed onto an inner wall surface of the main casing 60*a* at a bottom portion of the internal space of the main casing 60*a*, so as to form a bottom surface of the toner storage section 60*a*2. The bottom transfer board 63*a* is a concave curved-plate member that is curved in an upward-opening half-cylindrical shape when viewed along the z-axis direction in FIG. 2. The bottom transfer board 63*a* is smoothly connected with a lower end of the flat plate-shaped vertical transfer board 63*b*, so as to smoothly transfer the toner T stored in the toner storage section 60*a*2 to the lower end of the vertical transfer board 63*b*. The vertical transfer board 63*b* is fixed onto the inner wall surface of the main casing 60*a* and extends vertically so as to transfer the toner T vertically upward from the lower end of the vertical transfer board 63*b* connected with the bottom transfer board 63*a*. The upper end of the vertical transfer board 63*b* is substantially as high as the center of the development roller 62. The upper end of the vertical transfer board 63*b* is disposed to face the cylindrical-surface-shaped tonner carrying surface 62*a* of the development roller 62. In the embodiment, the bottom transfer board 63*a* and the vertical transfer board 63*b* are seamlessly integrated, and formed in a reversed J-shape when viewed along the z-axis direction in FIG. 2. The vertical transfer board 63*b* is configured to transfer the toner T received from the bottom transfer board 63*a* vertically upward to a toner carrying position TCP, which is located upstream relative to the development position DP in the moving direction of the toner carrying surface 62*a*. The retrieving board 63*c* is disposed to face the development roller 62 at a side opposed to the upper end of the vertical transfer board 63*b* across the development roller 62. The retrieving board 63*c* is configured to retrieve from the development roller 62 the toner T that remains on the toner carrying surface 62*a* without having been consumed in the development position DP and to transfer the retrieved toner T down toward the toner storage section 60*a*2.

An opposed member 64 is opposed to the toner carrying surface 62*a* in a position between the toner carrying position TCP and the development position DP in the moving direction of the toner carrying surface 62*a*. The opposed member 64 is configured to charge the toner T carried on the toner carrying surface 62*a* by the action of an alternating electric field generated between the opposed member 64 and the toner carrying surface 62*a*. In the embodiment, the opposed member 64, which is a roller-shaped member having a center axis parallel to the main scanning direction, is driven to rotate around the center axis. In addition, the toner supply device 6 includes a cleaning portion 65 configured to clean an opposed-roller surface 64*a*.

The bottom transfer board 63*a* and the vertical transfer board 63*b* of the transfer board 63 are electrically connected with a transfer power supply circuit 66. The retrieving board 63*c* is electrically connected with a retrieving power supply circuit 67. The development roller 62 is electrically connected with a development bias supply circuit 68. The transfer power supply circuit 66, the retrieving power supply circuit 67, and the development bias supply circuit 68 are configured to output respective voltages required for circulating the toner T in the toner transfer direction TTD along the toner transfer path TTP (specifically, voltages required for making the development roller 62 once carry the toner T stored in the toner storage section 60*a*2 to convey the toner T to the development position DP, retrieving from the development roller 62 the toner T that remains on the toner carrying surface 62*a* without having been consumed in the development position DP, and returning the retrieved toner T back to the toner storage section 60*a*2). The opposed member 64 is electrically connected with a charge bias supply circuit 69. The charge bias supply circuit 69 is configured to generate the alternating electric field in a position where the opposed member 64 (the opposed-roller surface 64*a*) is opposed to the development roller 62 (the toner carrying surface 62*a*) and charge the toner T carried on the toner carrying surface 62*a* by the action of the alternating electric field.

<<<Internal Configuration of Transfer Board>>>

Figure 3:
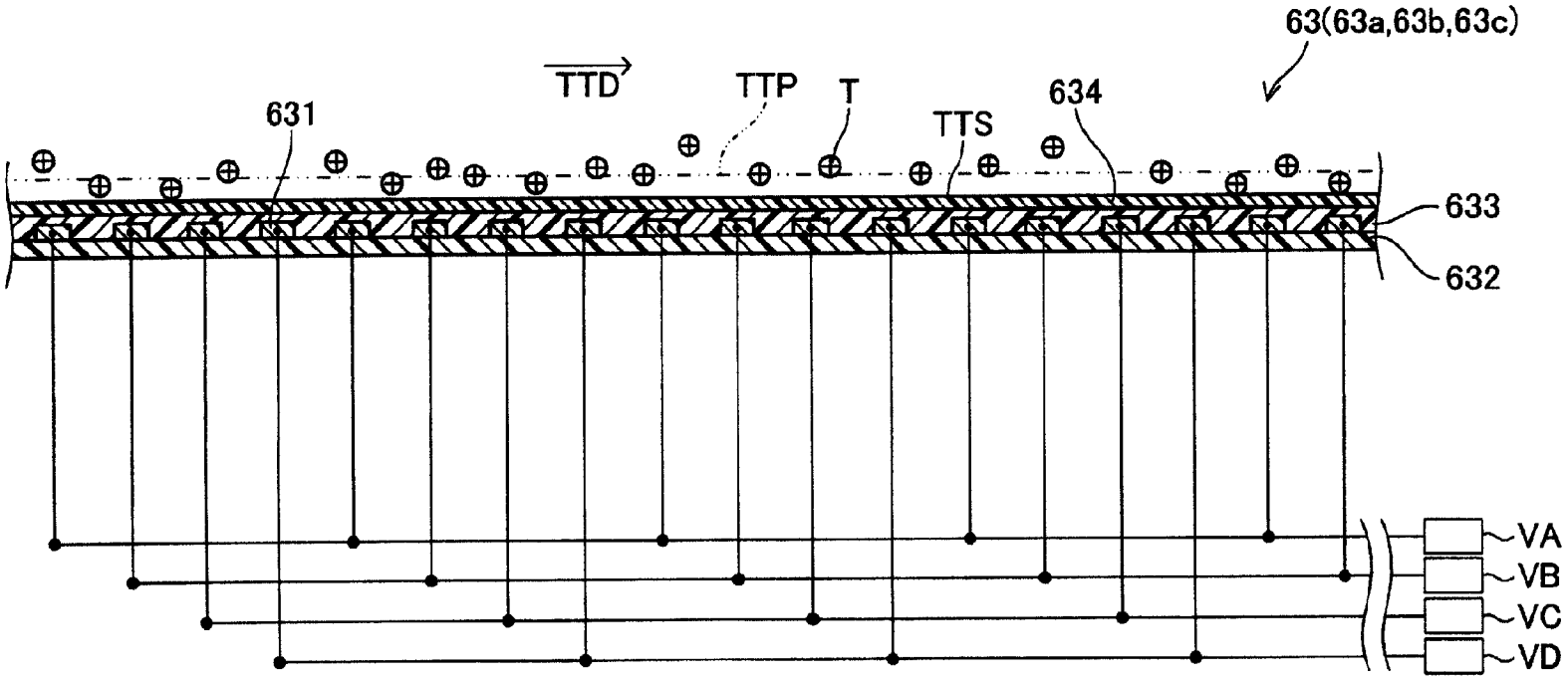
FIG. 3 is an enlarged cross-sectional side view of a transfer board for the toner supply device in the embodiment according to one or more aspects of the present invention.

As shown in FIG. 3, the transfer board 63 is a thin plate member configured in the same manner as a flexible printed-circuit board. Specifically, the transfer board 63 includes a plurality of transfer electrodes 631, a transfer electrode supporting film 632, a transfer electrode coating layer 633, and a transfer electrode overcoating layer 634. The transfer electrodes 631 are linear wiring patterns having a longitudinal direction parallel to the main scanning direction. For example, the transfer electrodes 62*a* are formed with copper thin films. The transfer electrodes 631 are arranged along the toner transfer path TTP in parallel with each other. Every fourth one of the transfer electrodes 631, arranged along the toner transfer path TTP, is connected with a specific one of four power supply circuits VA, VB, VC, and VD. In other words, the transfer electrodes 631 are arranged along the toner transfer path TTP in the following order: a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, . . . . In the embodiment, as shown in FIG. 4, the power supply circuits VA, VB, VC, and VD are configured to generate respective AC driving voltages having substantially the same waveform. Further, the power supply circuits VA, VB, VC, and VD are configured to generate the respective AC driving voltages with a phase difference of 90 degrees between any adjacent two of the power supply circuits VA, VB, VC, and VD in the aforementioned order. In other words, the power supply circuits VA, VB, VC, and VD are configured to output the respective AC driving voltages each of which is delayed by a phase of 90 degrees behind the voltage output from a precedent adjacent one of the power supply circuits VA, VB, VC, and VD in the aforementioned order.

The transfer electrodes 631 are formed on a surface of the transfer electrode supporting film 632. The transfer electrode supporting film 632 is a flexible film made of electrically insulated synthetic resin such as polyimide resin. The transfer electrode coating layer 633 is provided to coat the transfer electrodes 631 and the surface of the transfer electrode supporting film 632 on which the transfer electrodes 631 are formed. In the embodiment, the transfer electrode coating layer 633 is made of polyimide resin. On the transfer electrode coating layer 633, the transfer electrode overcoating layer 634 is provided. The surface (the toner transfer surface TTS) of the transfer electrode overcoating layer 634 is formed as a smooth surface with a very low level of irregularity, so as to smoothly convey the toner T. In the embodiment, the transfer electrode overcoating layer 634 is made of polyester resin, which is the same material as that for the core MP1 of the toner T.

<Specific Example of Method for Manufacturing Toner>

(1) Preparation of Suspension of Fine Particle Precursor to Mother Particles (1-1) Colorant dispersion liquid is prepared by agitating, by a homogenizer at a revolution of 1000 rpm for ten minutes, mixture solution of polyester resin (manufactured by Mitsubishi Rayon Co., Ltd., product ID: FC1565, Tg: 64° C., Mn (number average molecular weight): 4500, Mw (weight-average molecular weight): 70000, 0.8 weight percent gel, acid number: 6.0 [KOHmg/g]) of 15 g, carbon black (product ID: 260, manufactured by Mitsubishi Chemical Corporation) of 15 g, and MEK (methyl ethyl ketone) of 70 g.

(1-2) The prepared colorant dispersion liquid of 100 g is put into a bead mill (product ID: RMB-04, manufactured by IMEX Co., Ltd.) together with zirconia beads (diameter: 1 mm) of 450 g, and processed by the bead mill at an agitation speed of 2000 rpm for 60 minutes.

(1-3) The colorant dispersion liquid of 60 g processed by the bead mill and MEK of 678 g are rendered slowly mixed. Then, into the mixture solution of the colorant dispersion liquid and the MEK, polyester resin (the same specification as above) of 158.4 g and ester wax of 12.6 g (product ID: WEP-3, manufactured by NOF Corporation) are put and agitated to be mixed. Then, by agitating the mixture solution (the colorant dispersion liquid, the MEK, the polyester resin, and the ester wax) while heating the mixture solution at the solution temperature 70° C., polyester resin solution is prepared.

(1-4) The prepared polyester resin solution of 900 g, distilled water of 900 g, and sodium hydroxide solution (1N) of 9.0 g are mixed and agitated by the homogenizer at a revolution of 1500 rpm for 20 minutes to be emulsified.

(1-5) The prepared emulsified solution is transferred into a 2-liter separable flask. By heating and agitating the emulsified solution at the temperature 75° C. for 150 minutes while introducing nitrogen into the gas phase, the MEK is removed, and suspension is prepared, which contains fine particles (fine particle precursor to mother particles) dispersed therein that will be aggregated to form the mother particles.

(2) Preparation of Mother Particles (2-1) The prepared suspension, containing the fine particle precursor to mother particles, is diluted with distilled water to obtain diluted solution of 1600 g with a solid content concentration of 10%. To the obtained diluted solution, 5% water solution of anionic surfactant (polyoxyalkylene isodecyl ether, product ID: HITENOL XJ-630S, manufactured by DAI-ICHI KOGYO SEIYAKU Co., Ltd.) of 10 g and aluminum chloride solution (0.2 N) of 40 g are added. Then, the mixture solution is homogenized by the homogenizer at a revolution of 8000 rpm.

(2-2) After that, the homogenized mixture solution is transferred into a separable flask, and there heated at the temperature 44° C. while agitated by six flat-plate turbine blades (75 mm) at a revolution of 300 rpm such that the fine particles are aggregated. Thereafter, sodium hydroxide solution (0.2 N) of 70 g is put, as an aggregation inhibitor, into the mixture solution. Then, after the temperature of the mixture solution is raised to 90° C., the mixture solution is agitated for about six hours. Thereby, the suspension of the mother particles, which are aggregates of the fine particle precursor to mother particles, is prepared.

(2-3) The suspension of the mother particles is cooled down to room temperature.

(3) Absorption of Surfactant (3-1) Un-agglutinated substance and/or unreacted substance are removed from the suspension of the mother particles by solid-liquid separation filtering. Then, the remaining solid substance is again suspended with distilled water to the solid content concentration 10%.

(3-2) Non-ionic surfactant (manufactured by DAI-ICHI KOGYO SEIYAKU Co., Ltd., product ID: Epan 785 (polyoxyethylene-polyoxypropylene block copolymer, content rate of ethylene oxide: 85%)) corresponding to 0.5 weight percent is added to the suspension, while the suspension is being agitated. The suspension is agitated continuously for one hour.

(3-3) After the suspension is again filtered, the mother particles with the surfactant absorbing therearound are obtained.

(4) External Additive Process (4-1) The mother particles obtained by the filtering separation are dried at the temperature 50° C., so as to attain an amount of contained water equal to or less than 0.5 weight percent.

(4-2) To the dried mother particles of 100 g, hydrophobic silica (product ID: HVK 2150, manufactured by Clariant K.K.) of 1 g and hydrophobic silica (product number: NA50H, manufactured by NIPPON AEROSIL CO., LTD.) of 1 g are added. Then, the dried mother particles containing the hydrophobic silica are agitated by a powder handling gear (product name: MECHANOMill, manufactured by OKADA SEIKO CO., LTD.) at a revolution of 2500 rpm for three minutes. After that, coarse aggregation substance of hydrophobic silica is removed by screening.

<Evaluation Method>

An explanation will be provided below about a method for evaluating toner manufactured as above or in partially modified manufacturing methods.

(1) Amount of Polar Groups

The amount of polar groups of the toner is measured by an automatic potentiometric titrator (Model AT-510, manufactured by KYOTO ELECTRONICS MANUFACTURING CO., LTD.). Hereinafter, a procedure for measuring the amount of positive polar groups [mol/g] will be shown. It is noted that measurement of the amount of negative polar groups is opposite in use of reagents to measurement of the amount of positive polar groups. Specifically, benzethonium chloride is employed as specimen liquid, and sodium lauryl sulfate is employed as titration reagent. Further, the following procedure for measuring the amount of polar groups is a known method.

(1-1) A stir bar (rotor) of a magnetic stirrer distilled water of 30 g are put into a container with a lid. Then, precisely weighed toner of 1 g is put into the container.

(1-2) Sodium lauryl sulfate (0.004 M) of 3 g is put into the container. Then, the toner is dispersed by agitating the container in a shaking manner while applying an ultrasonic wave for 30 minutes.

(1-3) The toner-dispersed liquid is agitated by the magnetic stirrer for 30 minutes.

(1-4) The toner-dispersed liquid is filtered by a cellulose acetate membrane filter with openings of 0.8 μm. The filtered liquid is received by a 100 ml beaker previously weighed. After completion of filtering the toner-dispersed liquid, the filtered liquid is weighed. Then, distilled water is added to the liquid, so as to attain the amount of the liquid corresponding to 100 g. Thus, specimen liquid is prepared.

(1-5) The specimen liquid prepared as above is titrated with benzethonium chloride (0.00133 M).

(1-6) Based on the titration result, the amount of polar groups will be calculated in the following way.

First, the mole number W of sodium lauryl sulfate consumed in the titration is calculated based on the following expression (1).

$$W=(\text{concentration of sodium lauryl sulfate solution [mol/L]})\times(\text{titer [ml]})/1000 \quad (1)$$

Next, with respect to the mole number of sodium lauryl sulfate, a loss amount correction is made considering a loss amount of sodium lauryl sulfate caused by the filtering in preparation of the specimen liquid.

The total volume T [ml] of the liquid before the filtering is calculated based on the following expression (2). It is noted that, in the following calculation, each volume is determined based on the measured weight.

$$T=(\text{input of benzethonium chloride solution [ml]})+(\text{input of water [ml]})-(\text{water volatilization volume [ml]}) \quad (2)$$

Subsequently, based on the following expression (3), the mole number X [mol] of benzethonium chloride contained before the filtering is calculated by making the loss amount correction with respect to the mole number of sodium lauryl sulfate. Specifically, since one mole of benzethonium chloride reacts with one mole of sodium lauryl sulfate, it is possible to determine the mole number X [mol] of benzethonium chloride contained before the filtering by making the loss amount correction with respect to the mole number of sodium lauryl sulfate.

$$X=W\,[\text{mol}]\times T\,[\text{ml}]/(\text{the volume of the filtered liquid [ml]}) \quad (3)$$

Next, based on the following expression (4), the mole number Y [mol] of benzethonium chloride consumed by reaction with the polar groups is calculated by subtracting the mole number X [mol] of benzethonium chloride contained before the filtering from the mole number [mol] of firstly-added benzethonium chloride. The mole number Y [mol] of benzethonium chloride consumed by reaction with the polar groups corresponds to the amount of electrostatically active polar groups.

Y1=(concentration of benzethonium chloride solution [mol/L])

Y2=(input of benzethonium chloride solution [ml])

$$Y=Y1\times Y2/1000-X \quad (4)$$

Finally, based on the mole number Y [mol] of benzethonium chloride consumed by reaction with the polar groups, the following value Z [mol/g] is determined as the mole number of benzethonium chloride consumed by reaction with the polar groups per unit weight of the toner.

$$Z=Y\,[\text{mol}]/(\text{input of toner [g]})$$

(2) Desorption Rate of External Additive (2-1) Solution containing non-ionic surfactant (manufactured by Roche Diagnostics K.K., product name: Triton-X) of 0.2 weight percent, and toner of 2.6 g are put into a standard bottle No. 8. Then, the solution and the toner are stirred by a homo-mixer manufactured by Heidolph Instruments GmbH & Co. KG at a revolution of 15000 rpm for three minutes, such that the toner is wet and dispersed.

(2-2) The solution containing the toner is filtered by a cellulose acetate membrane filter with openings of 3 μm. The filtered solution is received by a 100 ml beaker.

(2-3) Turbidity of supernatant liquid is measured by a haze meter manufactured by Suga Test Instruments Co., Ltd. The desorption rate of the external additive is presumed based on the measured turbidity of supernatant liquid and a calibration curve previously created using dispersion liquid (for creating the calibration curve) in which silica fine particles of the same brand as the external additive of the toner are dispersed in an ultrasonic wave method.

(3) Spatula Angle (3-1) Toner of 50 g is uniformly put into a container in which a spatula is set, which container is fixed to a POWDER TESTER (trademark registered, Model PT-E) manufactured by HOSOKAWA MICRON CORPORATION. It is noted that the container and the spatula have previously been covered with polyimide tape.

(3-2) The container is slowly let down, and an inclined angle of the toner remaining on the spatula is measured.

(3-3) The inclined angle is again measured after a single shot of vibration is applied to the spatula by a vibrator provided to the tester. Thus, the spatula angle is determined as an average value of the inclined angles measured before and after the vibration applied to the spatula.

(4) Charge Amount of Toner Before Transferred (Charge Amount of Toner at Activating Portion)

An experimental prototype of the toner supply device 6 is provided, which has the same configuration as shown in FIG. 2. However, it is noted that the experimental prototype does not include the opposed member 64. The experimental prototype is provided with new toner, after substance adhering onto the surface of each component thereof has been removed using organic solvent. Hereinafter, the experimental prototype in this state will be referred to as an "initialized prototype." Using the initialized prototype, an electric-field toner transferring operation is carried out for one minute. After that, the experimental prototype is turned off and the auger 61 is taken out. Then, the charge amount of the toner at an activating portion (the toner near the transfer board 63 inside the toner storage section 60*a*2) is measured by an Espart Analyzer (trademark registered) manufactured by HOSOKAWA MICRON CORPORATION.

(5) Ratio of Negatively Charged Toner, Transferability, Printing Property

Using the initialized prototype, an electric-field toner transferring operation (e.g., an image forming operation by a test model of laser printer in which the initialized prototype is incorporated, using a standard printer evaluation pattern J5 defined by Japan Electronics and Information Technology Industries Association) is carried out for 12 hours. Then, a white fog evaluation is carried out by measuring a reflecting density of a background area using a Macbeth densitometer manufactured by Gretag-Macbeth Corporation (Model RD-914, aperture diameter: 2 mm) In the white fog evaluation, it is determined that a "white fog" is caused, when the measured reflecting density is equal to or more than 0.3. Further, transferability of the toner (evenness of toner activation, showing how evenly the toner is activated and transferred at the activating portion on the transfer board 63) is evaluated based on unevenness of the density of a solid area in the main scanning direction and an adhesion pattern of the toner adhering to the activating portion on the transfer board 63. With respect to the toner on an area of the toner carrying surface 62*a* that is downstream relative to the toner carrying position TCP and upstream relative to the position opposed to the opposed member 64 in the moving direction of the toner carrying surface 62*a*, a ratio of negatively charged toner (negatively charged particles) is measured by the Espart Analyzer (trademark registered) manufactured by HOSOKAWA MICRON CORPORATION.

<Evaluation Results>

An explanation will be provided below about results of evaluation of the toner manufactured as above or in partially modified manufacturing methods. With respect to the toner manufactured in the aforementioned manufacturing method (hereinafter referred to as a "first working example"), the printing property and the transferability thereof are good. Namely, there is not any white fog recognized, and evenness of electric-field toner transferring in the width direction is good (it is visually confirmed that the toner has been very smoothly transferred by the electric field). In the first working example, other evaluation results are shown below.

Amount of positive polar groups: 0 [mol/g]

Amount of negative polar groups: $8.7\times10^{-7}$ [mol/g]

Desorption rate of external additive: 18.8%

Spatula angle: 37.5 degrees

Charge amount at the activating portion (per 3000 toner particles): 1212 [fC]

Ratio of negatively charged toner: 8.2%

In a second working example, toner is prepared in a modified manufacturing method where the additive amount of the surfactant is changed from 0.5 weight percent down to 0.1 weight percent in the process of making the surfactant absorbed to the mother particles. Additionally, in a third working example, toner is prepared in a modified manufacturing method where the additive amount of the surfactant is further reduced down to 0.01 weight percent in the process of making the surfactant absorbed to the mother particles. Further, in a fourth working example, toner is prepared in a modified manufacturing method where the type of the surfactant is changed to polyoxyethylene laurylether (product ID: DNS NL-90 (HLB value: 13.4), manufactured by DAI-ICHI KOGYO SEIYAKU Co., Ltd.). Further, in a fifth working example, toner is prepared in a modified manufacturing method where the type of the surfactant is changed to polyoxyethylene oleyl cetyl ether (product name: NOIGEN ET-69 (HLB value: 5.7), manufactured by DAI-ICHI KOGYO SEIYAKU Co., Ltd.). In each of first and second comparative examples, toner is prepared in a modified manufacturing method to use surfactant having an amino group (polyethylenimine (molecular weight: 10000), product name: EPOMIN SP-200, manufactured by NIPPON SHOKUBAI Co., Ltd.). It is noted that the additive amount of the surfactant is 0.01 weight percent in the first comparative example, and the additive amount of the surfactant is 0.3 weight percent in the second comparative example. In a third comparative example, toner is prepared in a modified manufacturing method without a process of making any surfactant absorbed to the mother particles. Further, in a fourth comparative example, toner is prepared in a modified manufacturing method where a condition of the external additive process of the first working example is changed. Specifically, in the external additive process, the dried mother particles containing the hydrophobic silica are agitated at a revolution of 2800 rpm for 15 minutes.

FIGS. 5A and 5B are tables showing the evaluation results of the first to fifth working examples and the first to fourth comparative examples. In FIGS. 5A and 5B, the first, second, third, fourth, and fifth working examples are indicated in an abridged manner as WE1, WE2, WE3, WE4, and WE5, respectively. Further, the first, second, third, and fourth comparative examples are indicated in an abridged manner as CE1, CE2, CE3, and CE4, respectively. FIG. 6 shows a relationship between the charge amount of the toner at the activating portion and the ratio of negatively charged toner. In FIG. 6, a plurality of points are shown, which result from respective different conditions with respect to the amount of the toner at the activating portion and/or the rotational speed of the augers 61. Further, FIG. 7 shows a relationship between the spatula angle and the charge amount of the toner at the activating portion.

As shown in FIG. 6, when the charge amount of the toner at the activating portion exceeds 3000 fC per 3000 particles, the ratio of negatively charged toner is likely to exceed 20%. The negatively charged toner carried on the toner carrying surface 62*a* is partially changed to positively charged toner by an auxiliary charging action of the opposed member 64. However, when the ratio of negatively charged toner exceeds 20%, all of the negatively charged toner is not changed to positively charged toner. Thus, a white fog is caused by remaining negatively charged toner. Further, as shown in FIG. 7, there is a tendency that the spatula angle is rendered larger as the charge amount of the toner at the activating portion increases. In other words, FIG. 7 suggests a tendency that fluidity of the toner is rendered worse as the charge amount of the toner at the activating portion increases.

In this regard, as explicitly shown in FIG. 5B, in the first to fifth working examples, the ratio of negatively charged toner is equal to or less than 20%, there is not any white fog recognized, and the transferability of the toner is good. It is noted that, as shown in FIG. 5A, in the first to fifth working examples, there is not any positive polar group on the surfaces of the mother particles, the external additive is absorbed to the mother particles in a relatively easily desorbable manner (specifically, the desorption rate of the external additive is equal to or more than 0.5% when the toner is dispersed in the water solution containing the non-ionic surfactant of 0.2 weight percent for three minutes using the high-speed shearing machine), the spatula angle is less than 50 degrees, and the charge amount of the toner at the activating portion is equal to or more than 800 fC per 3000 particles and equal to or less than 3000 fC per 3000 particles.

Meanwhile, in the first comparative example, the transferability of the toner is good since the external additive is absorbed to the mother particles in a relatively easily desorbable manner, the spatula angle is less than 50 degrees, and the charge amount of the toner at the activating portion is equal to or more than 800 fC per 3000 particles and equal to or less than 3000 fC per 3000 particles. However, there are positive polar groups and negative polar groups on the surfaces of the mother particles, and it leads to a high ratio of negatively charged toner. Therefore, in the first comparative example, occurrence of a white fog is recognized. In the second comparative example, the external additive is absorbed to the mother particles in a relatively easily desorbable manner. However, the charge amount of the toner at the activating portion is more than 3000 fC per 3000 particles, and the spatula angle is equal to or more than 50 degrees. Further, there is not any negative polar group on the surfaces of the mother particles while there are positive polar groups on the surfaces of the mother particles. In the second comparative example, the ratio of negatively charged toner is high, a white fog is caused, and the transferability of the toner is no good (although the toner has managed to be vertically transferred and carried on the toner carrying surface 62*a*, remarkable unevenness of the toner in the main scanning direction is observed). In the third comparative example, although there is no positive polar group on the surfaces of the mother particles, the external additive is firmly absorbed to the mother particles (the desorption rate of the external additive is 0.0%), and the spatula angle is equal to or more than 50 degrees. In the third comparative example, the charge amount of the toner at the activating portion is equal to or more than 800 fC per 3000 particles and equal to or less than 3000 fC per 3000 particles, and the transferability of the toner in the vertical direction is barely ensured. However, remarkable unevenness of the toner in the main scanning direction is observed. In the fourth comparative example, although there is no positive polar group on the surfaces of the mother particles, the external additive is firmly absorbed to the mother particles. Further, although the spatula angle is less than 50 degrees, the charge amount of the toner at the activating portion is less than 800 fC per 3000 particles. In the fourth comparative example, the toner has not been transferred by the electric field. Therefore, it was impossible to carry out the white fog evaluation or the evaluation of the ratio of negatively charged toner.

The above results are considered to be brought for the following causes. As conducted in the first to fifth working examples, when the external additive (electrically-insulating fine particles having the positive charge polarity identical to that of the toner) is absorbed in an easily desorbable (movable) state to the outer surface of the mother particle that does not have any positive polar group, the external additive is positively charged for some causes. For instance, the external additive is positively charged by contact (friction) with the transfer board 63 (the surface of the transfer electrode overcoating layer 634, i.e., the toner transfer surface TTS) and/or by rotation or contact sliding of the external additive on the outer surface of the mother particle when the toner contacts the transfer board 63. At this time, even though the mother particle is negatively charged, the mother particle is covered with the positively charged external additive. Therefore, since the positively charged external additive exists on the outermost surface of the toner, the toner apparently behaves as being positively charged (when an external electric field is applied, e.g., in the electric-field toner transferring or the development). Thus, in the embodiment, the charge polarity of the toner is mainly determined by the charge polarity of the external additive.

The aforementioned charging of the toner, resulting from the movement of the external additive on the outer surface of the mother particle, is caused in the same manner even in any of the following states. The states include a state where the accumulated transfer time for transferring the toner by the transfer board 63 is relatively long such that the external additive desorbed from the mother particle electrostatically adheres onto the transfer board 63 (in this state, the external additive is less likely to be charged by contact with the transfer board 63), and a state where the accumulated transfer time is relatively short such that the external additive desorbed from the mother particle does not electrostatically adhere onto the transfer board 63. Further, with respect to the negatively charged toner, when the external additive is positively charged by friction with the outer surface of the mother particle as described above, it results in an increased ratio of such toner (particles) that the charge state of the toner itself is changed into the positively charged state.

As described above, in the embodiment, the toner is charged in a stable manner as the external additive is allowed to move on the outer surface of the mother particle in a favorable manner. Hence, there is a small difference in the charge state of the toner between when the accumulated transfer time for transferring the toner by the transfer board 63 is short and when the accumulated transfer time is long. Thus, it is possible to put the negatively charged toner into the positively charged state.

In addition, when the charge amount of the toner at the activating portion is equal to or more than 800 fC per 3000 particles and the spatula angle is less than 50 degrees, the toner is allowed to have a sufficient charge amount and a sufficient fluidity. Thus, the toner is allowed to be activated by the electric field in a more effective manner. Moreover, when the charge amount of the toner at the activating portion is equal to or less than 3000 fC per 3000 particles, it is possible to prevent the toner from being negatively charged or being aggregated, as effectively as possible.

Thus, according to the embodiment, it is possible to avoid an unstably charged toner or unstable transferability of the toner to be transferred by the electric field, as effectively as possible. Thereby, it is possible to supply the positively charged toner in a stable and favorable manner.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

<Modifications>

The toner supply device 6 may be configured without the opposed member 64 or elements accompanying the opposed member 64.

The transfer board 63 may be provided with a down-facing toner transfer surface TTS. As shown in FIG. 9, the casing 60 of the toner supply device 6 may be a box-shaped member that has a longitudinal direction parallel to the horizontal direction (i.e., the x-axis direction in FIGS. 8 and 9) when viewed along the z-axis direction. The opening 60*a*1 may be provided at an end of the casing 60 opposed to the photoconductive drum 3 in the longitudinal direction of the casing 60. The toner storage section 60*a*2 may be provided at a side opposite to the opening 60*a*1 in the longitudinal direction of the casing 60, at a bottom portion inside the casing 60. Further, toner storage section 60*a*2 may be formed to be substantially an upward-opening C-shaped room when viewed along the z-axis direction. The toner storage section 60*a*2 stores the toner T in a state just before being transferred by the electric field. In the modification, the toner supply device 6 may be configured such that the absolute value of the charge amount of the toner T stored in the toner storage section 60*a*2 is equal to or more than 800 fC per 3000 particles and equal to or less than 3000 fC per 3000 particles.

At the bottom portion inside the casing 60, there may be subsidiary toner storage sections 60*a*3 and 60*a*4 each of which is formed to be substantially an upward-opening C-shaped room when viewed along the z-axis direction and disposed adjacent to the toner storage section 60*a*2. Between the toner storage section 60*a*2 and the subsidiary toner storage section 60*a*3, there may be a separation wall 60*a*5 formed along the main scanning direction. Further, between the subsidiary toner storage section 60*a*3 and the subsidiary toner storage section 60*a*4, there may be a separation wall 60*a*6 formed along the main scanning direction. The subsidiary toner storage sections 60*a*3 and 60*a*4 may be connected with each other at both ends thereof in the main scanning direction, such that the toner T flows between the subsidiary toner storage sections 60*a*3 and 60*a*4.

In the internal space of the casing 60, a shield member 60*a*7 may be provided. The shield member 60*a*7 may be a plate member formed substantially in an arc shape when viewed along the z-axis direction. The shield member 60*a*7 may be formed to divide the internal space of the casing 60 into a roller housing section 60*a*8 at a side closer to the opening 60*a*1 in the longitudinal direction of the casing 60 and a remaining section other than the roller housing section 60*a*8. The roller housing section 60*a*8 may be configured to accommodate the development roller 62. Namely, the shield member 60*a*7 may be configured to shield the development roller 62 from a space where the toner T is stored (i.e., from the remaining section other than the roller housing section 60*a*8 inside the casing 60).

A bottom plate 60*a*9 and a top plate 60*a*A may be connected with each other at a side closer to the toner storage section 60*a*2 in the longitudinal direction of the casing 60. Further, the bottom plate 60*a*9 and the top plate 60*a*A may be smoothly connected to form a substantially arc shape when viewed along the z-axis direction. The top plate 60*a*A may include a projection 60*a*B that protrudes toward the inside of the casing 60 and is formed along the main scanning direction. The projection 60*a*B may be disposed in such a position as to separate the internal space of the casing 60 into the roller housing section 60*a*8 and the remaining section other than the roller housing section 60*a*8. Specifically, the projection 60*a*B may be disposed to face the shield member 60*a*7. A surface of the projection 60*a*B that faces the shield member 60*a*7 may be formed to be a concave surface substantially along a surface of the shield member 60*a*7.

In the modification, the transfer board 63 may include a first transfer board 63*d*, a second transfer board 63*e*, and a third transfer board 63*f*. The first transfer board 63*d* may be fixed onto an inner wall surface of the top plate 60*a*A of the casing 60, such that a first toner transfer surface TTS1, which is a down-facing surface of the first transfer board 63*d*, is provided along the longitudinal direction of the casing 60. Further, the first transfer board 63*d* may extend from the side closer to the toner storage section 60*a*2 in the longitudinal direction of the casing 60 to the surface of the projection 60*a*B that faces the shield member 60*a*7. The second transfer board 63*e* may be fixed onto a surface of the shield member 60*a*7 that faces the projection 60*a*B and the development roller 62. A surface of the second transfer board 63*e* may be referred to as a "second toner transfer surface TTS2." At a downstream end of the first transfer board 63*d* in the toner transfer direction TTD, the first toner transfer surface TTS1 may be formed in a concave cylindrical surface shape along the second toner transfer surface TTS2. The second transfer board 63*e* may include an upstream section 63*e*1 that faces the downstream end of the first transfer board 63*d* in the toner transfer direction TTD, and a downstream section 63*e*2 that is opposed in closest proximity to the development roller 62. The second transfer board 63*e* may be configured to receive the toner T at the upstream section 63*e*1 from the first transfer board 63*d*, transfer the received toner T to the downstream section 63*e*2 by a traveling-wave electric field, and supply the toner T to the toner carrying surface 62*a* at the downstream section 63*e*2. A portion of the downstream section 63e2, which portion is located downstream relative to the position opposed in closest proximity to the development roller 62 in the toner transfer direction TTD, may be configured to transfer the toner T toward the subsidiary toner storage section 60a4.

The third transfer board 63f may be fixed to an end, closer to the toner storage section 60a2, of an inner wall surface of the bottom plate 60a9 of the casing 60 in the longitudinal direction of the casing 60. The third transfer board 63f may be configured such that an upstream end thereof in the toner transfer direction TTD is immersed in the toner T stored in the toner storage section 60a2. Further, a downstream end of the third transfer board 63f in the toner transfer direction TTD may be connected with an upstream end of the first transfer board 63d in the toner transfer direction TTD. Namely, the toner transfer surface TTS of the third transfer board 63f may form a slant face extending up toward the upstream end of the first transfer board 63d in the toner transfer direction TTD.

An agitator 601 may be provided in a position, corresponding to the toner storage section 60a2, of the bottom portion of the casing 60. The agitator 601 may include a shaft 601a that forms a rotational center axis parallel to the main scanning direction, and an agitating bar 601b formed radially outside the shaft 601a. The agitating bar 601b may be a bar-shaped member having a longitudinal direction along the shaft 601a, and typically provided in parallel with the shaft 601a. The agitator 601 is configured to, when the shaft 601a is driven to rotate, agitate the toner T in the toner storage section 60a2.

A first auger 61a and a second auger 61b may be provided at the bottom portion inside the casing 60. The first auger 61a and the second auger 61b may be configured to agitate the previously-stored toner T and the toner T coming down (retrieved) from the first transfer board 63d (the first toner transfer surface TTS1), in the subsidiary toner storage sections 60a3 and 60a4 adjacent to the toner storage section 60a2 at the bottom portion of the casing 60. Further, the first auger 61a and the second auger 61b may be configured to convey the toner T to the toner storage section 60a2.

The first auger 61a may be disposed in a position corresponding to the subsidiary toner storage section 60a3. The first auger 61a may include a shaft 61a1 that forms a rotational center axis parallel to the main scanning direction, and a corkscrew blade 61a2 formed around the shaft 61a1. The first auger 61a may be configured to, when the shaft 61a1 is driven to rotate, convey the toner T in a first direction (e.g., a positive direction along the z-axis in FIG. 9) parallel to the main scanning direction while agitating the toner T in the subsidiary toner storage section 60a3. The second auger 61b may be disposed in a position corresponding to the subsidiary toner storage section 60a4. The second auger 61b may include a shaft 61b1 that forms a rotational center axis parallel to the main scanning direction, and a corkscrew blade 61b2 formed around the shaft 61b1. The second auger 61b may be configured to, when the shaft 61b1 is driven to rotate, convey the toner T in a second direction (e.g., a negative direction along the z-axis in FIG. 9) opposite to the first direction and parallel to the main scanning direction while agitating the toner T in the subsidiary toner storage section 60a4.

In the modification, the toner T having the same properties as exemplified in the aforementioned embodiment may be transferred on the down-facing first toner transfer surface TTS1 of the first transfer board 63d with a favorable transferability. Thus, the ratio of negatively charged toner with respect to the toner T carried on the toner carrying surface 62a may be restrained and reduced as effectively as possible.

What is claimed is:

1. A developer supply device comprising:

a casing comprising:

a developer storage section provided at a bottom portion therein; and an opening formed at an end thereof away from the developer storage section;

powdery development agent chargeable with a predetermined polarity, stored in the developer storage section of the casing, the development agent comprising:

a mother particle having, around an outer surface thereof, an electrically insulating layer without a polar group having a charge polarity identical to the predetermined polarity; and an external additive absorbed to around the mother particle in an easily desorbable manner, the external additive being an electrically insulating fine particle having a charge polarity identical to the predetermined polarity; and a transfer board disposed in the casing, the transfer board comprising a plurality of transfer electrodes arranged along a developer transfer path from developer storage section to the opening, the transfer board being configured to, when a multi-phase alternating-current voltage is applied to the plurality of transfer electrodes, transfer the development agent from the developer storage section toward the opening along the developer transfer path, so as to supply an intended device with the development agent charged with the predetermined polarity.

2. The developer supply device according to claim 1, wherein the external additive is absorbed to around the mother particle such that a desorption rate of the external additive is equal to or more than 0.5 percent when the development agent is dispersed in water solution containing non-ionic surfactant of 0.2 weight percent for three minutes using a high-speed shearing machine.

3. The developer supply device according to claim 1, wherein the development agent has an absolute value of a charge amount thereof equal to or more than 800 fC per 3000 particles in the developer storage section, and wherein the development agent has a spatula angle less than 50 degrees.

4. The developer supply device according to claim 1, wherein the development agent has an absolute value of a charge amount thereof equal to or less than 3000 fC per 3000 particles in the developer storage section.

5. The developer supply device according to claim 1, wherein the transfer board is configured to transfer the development agent vertically upward from the developer storage section.

6. The developer supply device according to claim 1, wherein the transfer board comprises a down-facing developer transfer surface on which the development agent is transferred.

7. An image forming apparatus comprising:

an image carrying body configured to carry an electrostatic latent image; and a developer supply device comprising:

a casing comprising:

a developer storage section provided at a bottom portion therein; and an opening formed at an end thereof away from the developer storage section;

powdery development agent chargeable with a predetermined polarity, stored in the developer storage section of the casing, the development agent comprising:

a mother particle having, around an outer surface thereof, an electrically insulating layer without a polar group having a charge polarity identical to the predetermined polarity; and an external additive absorbed to around the mother particle in an easily desorbable manner, the external additive being an electrically insulating fine particle having a charge polarity identical to the predetermined polarity;

a transfer board disposed in the casing, the transfer board comprising a plurality of transfer electrodes arranged along a developer transfer path from developer storage section to the opening, the transfer board being configured to, when a multi-phase alternating-current voltage is applied to the plurality of transfer electrodes, transfer the development agent from the developer storage section toward the opening along the developer transfer path; and a developer carrying body disposed to face the image carrying body, the developer carrying body being rotatably supported at the end of the casing where the opening is formed, the developer carrying body being configured to receive the development agent transferred by the transfer board and supply the image carrying body with the development agent charged with the predetermined polarity to develop the electrostatic latent image carried on the image carrying body.

8. The image forming apparatus according to claim 7, wherein the external additive is absorbed to around the mother particle such that a desorption rate of the external additive is equal to or more than 0.5 percent when the development agent is dispersed in water solution containing non-ionic surfactant of 0.2 weight percent for three minutes using a high-speed shearing machine.

9. The image forming apparatus according to claim 7, wherein the development agent has an absolute value of a charge amount thereof equal to or more than 800 fC per 3000 particles in the developer storage section, and wherein the development agent has a spatula angle less than 50 degrees.

10. The image forming apparatus according to claim 7, wherein the development agent has an absolute value of a charge amount thereof equal to or less than 3000 fC per 3000 particles in the developer storage section.

11. The image forming apparatus according to claim 7, wherein the transfer board is configured to transfer the development agent vertically upward from the developer storage section.

12. The image forming apparatus according to claim 7, wherein the transfer board comprises a down-facing developer transfer surface on which the development agent is transferred.

* * * * *